US005299544A

United States Patent [19]

Kitamoto et al.

[11] Patent Number: 5,299,544

[45] Date of Patent: Apr. 5, 1994

[54] EVAPORATIVE FUEL-PURGING CONTROL SYSTEM FOR INTERNAL COMBUSTION ENGINES

[75] Inventors: Masakazu Kitamoto; Fumio Hosoda; Hideo Moriwaki; Kojiro Tsutsumi; Teruo Wakashiro; Toshikastu Takanohashi; Hiroshi Kitagawa, all of Wako, Japan

[73] Assignee: Honda Giken Kogyo Kabushiki Kaisha, Tokyo, Japan

[21] Appl. No.: 899,686

[22] Filed: Jun. 16, 1992

[30] Foreign Application Priority Data

Jun. 17, 1991 [JP] Japan ..... 3-171761
Dec. 9, 1991 [JP] Japan ..... 3-324755
May 26, 1992 [JP] Japan ..... 4-158645

[51] Int. Cl.[5] ..... F02M 33/02
[52] U.S. Cl. ..... 123/520; 123/198 D
[58] Field of Search ..... 123/520, 519, 518, 516, 123/198 D, 521

[56] References Cited

U.S. PATENT DOCUMENTS 4,949,695 7/1989 Uranishi ..... 123/520
5,139,001 8/1992 Tada ..... 123/520
5,143,040 9/1992 Okawa ..... 123/520
5,178,117 1/1993 Fujimoto ..... 123/520
5,186,153 2/1993 Steinbrenner ..... 123/198 D
5,188,085 2/1993 Habaguchi ..... 123/520

*Primary Examiner*—Carl S. Miller
*Attorney, Agent, or Firm*—Nikaido, Marmelstein, Murray & Oram

[57] ABSTRACT

An evaporative fuel-purging control system for an internal combustion engine includes at least one flowmeter arranged across a purging passage for outputting a detection parameter indicative of a flow rate of a gaseous mixtured purged through the purging passage, and a purge control valve arranged across the purging passage for controlling the flow rate of the gaseous mixture based on a control parameter indicative of a control amount for the purge control valve. One of the detection parameter and the control parameter is corrected based on a value of the one of the detection parameter and the control parameter assumed when the other of the detection parameter and the control parameter assumes a value corresponding to a state in which the flow rate of the gaseous mixture is equal to the minimum value.

26 Claims, 10 Drawing Sheets

EVAPORATIVE FUEL-PURGING CONTROL SYSTEM FOR INTERNAL COMBUSTION ENGINES

BACKGROUND OF THE INVENTION

1. Field of the Invention

This invention relates to an evaporative fuel-purging control system for internal combustion engines equipped with evaporative emission control systems.

2. Prior Art

Conventionally, evaporative emission control systems have widely been used in internal combustion engines, which operate to prevent evaporative fuel (fuel vapor) from being emitted from a fuel tank into the atmosphere, by temporarily storing evaporative fuel from the fuel tank in a canister, and purging same into the intake system of the engine. Purging of evaporative fuel into the intake system causes enriching of an air-fuel mixture supplied to the engine, so that the air-fuel ratio of the mixture deviates from a desired value. To overcome this disadvantage, an evaporative fuel-purging control system has already been proposed in U.S. Ser. No. 07/853,288 by the present assignee, in which a mass flowmeter is inserted in a purging passage extending between the canister and the intake system for measuring the flow rate (purging flow rate) of a mixture of air and the evaporative fuel flowing through the purging passage, to correct the air-fuel ratio in dependence on the measured flow rate.

According to the proposed system, the opening of a purge control valve, which is provided across the purging passage for controlling the flow rate of the mixture in the purging passage, is controlled so as to make the detected output value from the mass flowmeter equal to a desired value.

In general, the purging flow rate varies greatly between a very small value and a very large value, depending on the amount of evaporative fuel stored in the canister and negative pressure within the intake system acting to draw the mixture from the purging passage into the intake system. Further, the concentration of evaporative fuel in the mixture flowing through the purging passage largely affects the air-fuel ratio of the whole mixture supplied to the engine. Particularly when the engine is operating under a low load condition, the amount and/or concentration of evaporative fuel purged has a great influence on the air-fuel ratio due to a reduced amount of fuel injected into the engine.

However, in the proposed system, the zero point correction of the output from the flowmeter is not carried out, so that a large error can occur in the output value from the flowmeter, i.e. the measured flow rate of the purged mixture particularly when the purging flow rate is small (i.e. under a low load operating condition of the engine), which brings about a problem of insufficient accuracy of control of the air-fuel ratio by the use of the purge control valve.

On the other hand, the purge control valve may be a duty control type as disclosed e.g. in Japanese Provisional Patent Publication (Kokai) No. 62-20669. In such a case, the purge control valve is substantially closed when the duty ratio of the valve is in a very small value region, so that the purging flow rate is substantially reduced to the minimum value. In view of this fact, in the disclosed system, a maximum value of the duty ratio at which the purging flow rate is maintained at the minimum value is checked and stored beforehand, and a duty ratio corresponding to a desired purging flow rate is calculated by the use of the stored maximum value of the duty ratio as a control zero point, whereupon a signal indicative of the calculated duty ratio is supplied to the purge control valve.

However, the aforementioned maximum of the duty ratio at which the purging flow rate is maintained at the minimum value varies from one purge control valve to another, and also changes with aging of the valve. Therefore, if the control zero point is set to the same or fixed value for all the purge control valves or irrespective of aging of the valve, it is impossible to obtain the same purging flow rate even if a signal indicative of the same duty ratio is supplied to the purge control valves, i.e. there can arise an error in the purging flow rate.

SUMMARY OF THE INVENTION

It is an object of the invention to provide an evaporative fuel-purging control system which has improved detecting accuracy of a flowmeter used therein for measuring the purging flow rate, and is capable of achieving more accurate air-fuel ratio control by the use of a purge control valve, particularly when the engine is operating in a low load condition.

It is another object of the invention to provide an evaporative fuel-purging control system which is capable of controlling the purging flow rate more accurately by correcting the control zero point value of the duty ratio of the purge control valve.

To attain the above objects, the invention provides an evaporative fuel-purging control system for an internal combustion engine having a fuel tank, and an intake passage, the evaporative fuel-purging control system including a canister for adsorbing evaporative fuel generated from the fuel tank, a purging passage connecting between the canister and the intake passage for purging a gaseous mixture containing the evaporative fuel therethrough into the intake passage, at least one flowmeter arranged across the purging passage for outputting a detection parameter indicative of a flow rate of the gaseous mixture being purged through the purging passage, and a purge control valve arranged across the purging passage for controlling the flow rate of the gaseous mixture supplied to the intake passage, based on a control parameter indicative of a control amount for the purge control valve.

The evaporative fuel-purging control system according to the invention is characterized by comprising correcting means for correcting one of the detection parameter and the control parameter, based on a value of the one of the detection parameter and the control parameter assumed and stored when the other of the detection parameter and the control parameter assumes a value corresponding to a state in which the flow rate of the gaseous mixture is equal to the minimum value.

To attain the first-mentioned object of the invention, according to one preferred form of the invention, there is provided an evaporative fuel-purging control system for an internal combustion engine having a fuel tank, and an intake passage, the evaporative fuel-purging control system including a canister for adsorbing evaporative fuel generated from the fuel tank, a purging passage connecting between the canister and the intake passage for purging a gaseous mixture containing the evaporative fuel therethrough into the intake passage, at least one flowmeter arranged across the purging passage for outputting an output value indicative of a flow rate of the gaseous mixture being purged through the purging passage, and a purge control valve arranged across the purging passage for controlling the flow rate of the gaseous mixture supplied to the intake passage.

The evaporative fuel-purging control system according to the one preferred form of the invention is characterized by comprising output correcting means for determining at least one zero point correction value, based on the output value outputted from the at east one flowmeter when the purge control valve is fully closed, and correcting the output value outputted from the at least one flowmeter based on the at least one zero point correction value determined, when the gaseous mixture is purged.

Preferably, the output correcting means determines and stores the at least one zero point correction value based on the output value from the at least one flowmeter outputted after a predetermined time period has elapsed after the purge control value was fully closed, and corrects an output value subsequently outputted from the at least one flowmeter based on the at least one zero point correction value stored.

More preferably, the output correcting means calculates an average value of the output value from the at least one flowmeter outputted over a second predetermined time period after the first-mentioned predetermined time period elapsed after the purge control valve was fully closed, and stores the average value calculated, as the at least one zero point correction value.

Further preferably, the average value is an average value of values outputted from the at least one flowmeter whenever a very short time period elapses, over the second predetermined time period.

Alternatively, the output correcting means calculates a difference between output values outputted from the at least one flowmeter when third and fourth predetermined time periods have passed after the purge control valve was fully closed, and calculates and stores the at least one zero point correction value based on the difference calculated.

Preferably, the at least one zero point correction value is calculated by subtracting a product of the difference multiplied by a predetermined coefficient, from an output value outputted from the at least one flowmeter when the third predetermined time period has elapsed.

Preferably, when the at least one zero point correction value falls within a predetermined range, the output correcting means stores and thereby renews the at least one zero point correction value.

For example, the at least one flowmeter comprises a mass flowmeter.

The mass flowmeter may be a hot wire type.

Alternatively, the at least one flowmeter comprises a mass flowmeter and a second flowmeter of another type having a different output characteristic from that of the mass flowmeter.

Preferably, when the zero point correction values for the mass flowmeter and the second flowmeter fall within respective predetermined ranges, and at the same time an absolute value of a difference between the zero point correction values for the mass flowmeter and the second flowmeter falls within a predetermined range, the output correcting means stores and thereby renews the zero point correction values for the mass flowmeter and the second flowmeter.

For example, the second flowmeter is a volumetric flowmeter.

The volumetric flowmeter is a differential pressure type flowmeter.

Further alternatively, the at least one flowmeter comprises first and second mass flowmeters, the purging passage comprising a main passage extending from the canister, the main passage having the first mass flowmeter and the purge control valve arranged therein, and a branch passage branching off the main passage at an intermediate location between the first mass flowmeter and the purge control valve and communicating with the atmosphere, the branch passage having the second mass flowmeter arranged therein.

In this case as well, it is preferred that when the zero point correction values for the first mass flowmeter and the second mass flowmeter fall within respective predetermined ranges, and at the same time an absolute value of a difference between the zero point correction values for the first mass flowmeter and the second mass flowmeter falls within a predetermined range, the output correcting means stores and thereby renews the zero point correction values for the first mass flowmeter and the second mass flowmeter.

To attain the second-mentioned object of the invention, according to another preferred form of the invention, there is provided an evaporative fuel-purging control system for an internal combustion engine having a fuel tank, and an intake passage, the evaporative fuel-purging control system including a canister for adsorbing evaporative fuel generated from the fuel tank, a purging passage connecting between the canister and the intake passage for purging a gaseous mixture containing the evaporative fuel therethrough into the intake passage, at least one flowmeter arranged across the purging passage for outputting an output value indicative of a flow rate of the gaseous mixture being purged through the purging passage, and a duty controlled type purge control valve arranged across the purging passage and supplied with a control signal for controlling the flow rate of the gaseous mixture supplied to the intake passage.

The evaporative fuel-purging control system according to this preferred form of the invention is characterized by comprising zero point correcting means for detecting a maximum value of a duty ratio of the control signal supplied to the purge control valve at which the flow rate of the gaseous mixture detected by the at least one flowmeter is maintained at the minimum value, and renewing a control zero point value of the duty ratio of the control signal to the detected maximum value of the duty ratio of the control signal, a value of the duty ratio corresponding to a desired value of the flow rate of the gaseous mixture being determined with reference to the control zero point.

In determining the maximum value of the duty ratio of the control signal, the zero point correcting means progressively decreases the duty ratio until the flow rate of the gaseous mixture becomes equal to the minimum value, and then progressively increases the duty ratio until the flow rate of the gaseous mixture is no longer equal to the minimum value.

Preferably, the progressive decrease of the duty ratio is effected by the use of a decrement which is larger than an increment used in the progressive increase of the duty ratio.

More preferably, the decrement is progressively decreased.

Further preferably, when the flow rate of the gaseous mixture detected by the flowmeter is within a predetermined tolerance range when the duty ratio of the control signal is reduced to a value of the control zero point value currently in use, the renewal of the control zero point value is omitted.

Alternatively, in determining the maximum value of the duty ratio of the control signal, the zero point correcting means progressively increases the duty ratio until the flow rate of the gaseous mixture rises from the minimum value, and then progressively decreases the duty ratio until the flow rate of the gaseous mixture becomes equal to the minimum value.

Preferably, the progressive increase of the duty ratio is effected by the use of an increment which is larger than a decrement used in the progressive decrease of the duty ratio.

More preferably, the increment is progressively decreased.

The above and other objects, features, and advantages of the invention will become more apparent from the ensuing detailed description taken in conjunction with the accompanying drawings.

DETAILED DESCRIPTION

The invention will now be described in detail with reference to the drawings showing embodiments thereof.

Figure 1:
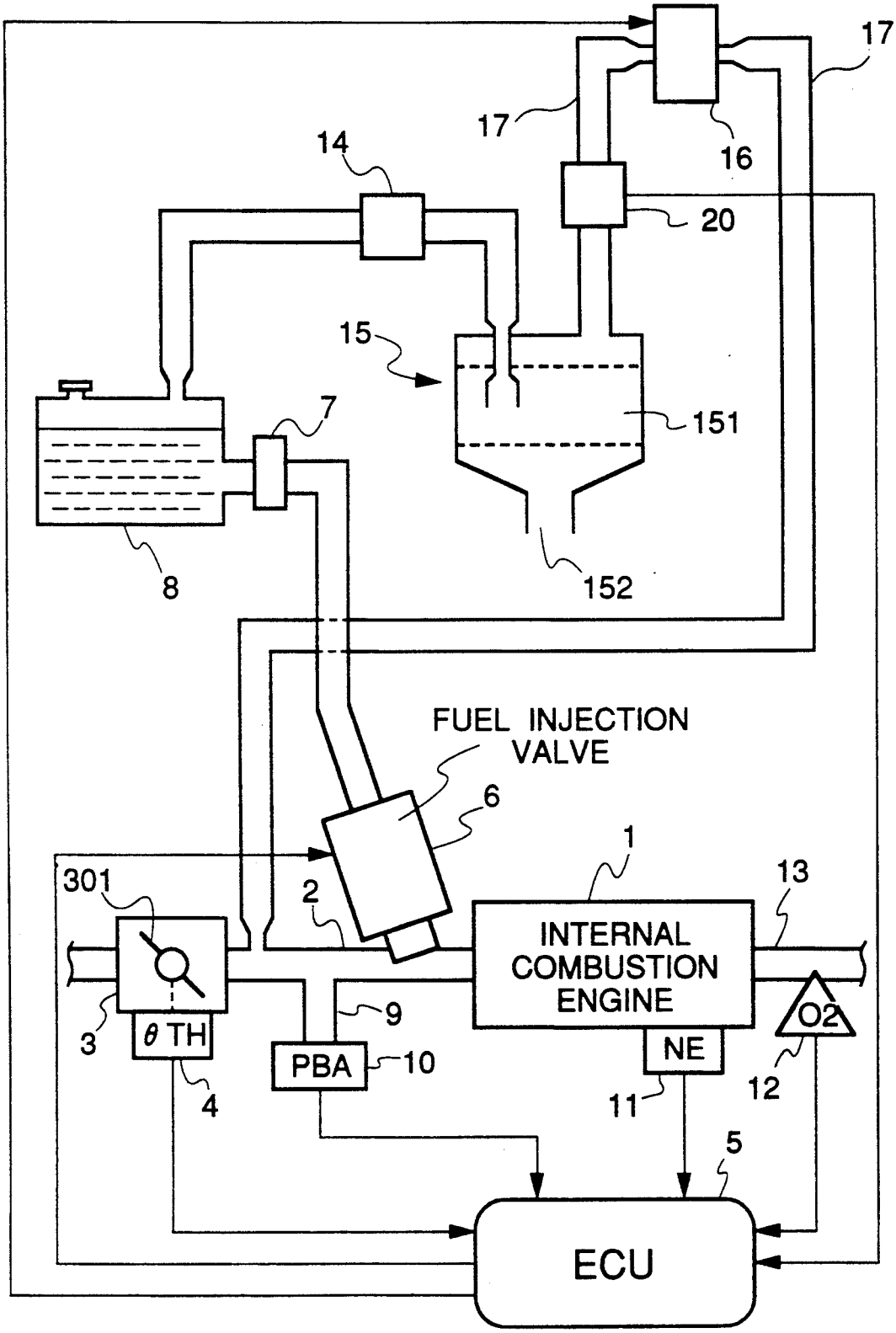
FIG. 1 is a block diagram showing the whole arrangement of a fuel supply control system of an internal combustion engine incorporating an evaporative fuel-purging control system according to a first embodiment of the invention.

Referring first to FIG. 1, there is illustrated the whole arrangement of a fuel supply control system of an internal combustion engine which is equipped with an evaporative fuel-purging control system according to a first embodiment of the invention. In the figure, reference numeral 1 designates an internal combustion engine which is installed in an automotive vehicle, not shown. The engine is a four-cylinder type, for instance. Connected to the cylinder block of the engine 1 is an intake pipe 2 across which is arranged a throttle body 3 accommodating a throttle valve 301 therein. A throttle valve opening ($\theta$TH) sensor 4 is connected to the throttle valve 301 for generating an electric signal indicative of the sensed throttle valve opening and supplying same to an electronic control unit (hereinafter called "the ECU") 5. The ECU 5 forms output correcting means.

Fuel injection valves 6, only one of which is shown, are inserted into the interior of the intake pipe 2 at locations intermediate between the cylinder block of the engine 1 and the throttle valve 301 and slightly upstream of respective intake valves, not shown. The fuel injection valves 6 are connected to a fuel tank 8 via a fuel pump 7, and electrically connected to the ECU 5 to have their valve opening periods controlled by signals therefrom.

On the other hand, an intake pipe pressure (PB) sensor 10 is provided in communication with the interior of the intake pipe 2 via a conduit 9 at a location immediately downstream of the throttle valve 301 for supplying an electric signal indicative of the sensed pressure within the intake pipe 2 to the ECU 5.

An engine rotational speed (NE) sensor 11 is arranged in facing relation to a camshaft or a crankshaft of the engine 1, not shown. The engine rotational speed sensor 11 generates a pulse as a TDC signal pulse at each of predetermined crank angles whenever the crankshaft rotates through 180 degrees, the pulse being supplied to the ECU 5.

An $O_2$ sensor 12 as an exhaust gas ingredient concentration sensor is mounted in an exhaust pipe 13 connected to the cylinder block of the engine 1, for sensing the concentration of oxygen present in exhaust gases emitted from the engine 1 and supplying an electric signal indicative of the sensed oxygen concentration to the ECU 5.

A conduit line (purging passage) 17 extends from an upper space in the fuel tank 8 which has an enclosed body, and opens into the intake pipe 2 at a location downstream of the throttle body 3. Arranged across the conduit line 17 is an evaporative emission control system (part of the evaporative fuel-purging control system) comprising a two-way valve 14, a canister 15 having an adsorbent 151, and a purge control valve 16 in the form of a linear control valve which has a solenoid, not shown, for driving a valve element thereof, not shown. The solenoid of the purge control valve 16 is connected to the ECU 5 and controlled by a signal supplied therefrom to change the valve opening (EPCV) linearly. According to this evaporative emission control system, evaporative fuel or fuel vapor (hereinafter merely referred to as "evaporative fuel") generated within the fuel tank 8 forcibly opens a positive pressure valve, not shown, of the two-way valve 14 when the pressure of the evaporative fuel reaches a predetermined level, to flow through the valve 14 into the canister 15, where the evaporative fuel is adsorbed by the adsorbent 151 in the canister and thus stored therein. The purge control valve 16 is closed when its solenoid is not energized by the control signal from the ECU 5, whereas it is opened when the solenoid is energized, whereby negative pressure in the intake pipe 2 causes evaporative fuel temporarily stored in the canister 15 to flow therefrom together with fresh air introduced through an outside air-introducing port 152 of the canister 15 at the flow rate determined by the valve opening of the purge control valve 16 corresponding to the current amount of the signal applied thereto, through the purging passage 17 into the intake pipe 2 to be supplied to the cylinders. When the fuel tank 8 is cooled due to low ambient temperature, etc. so that negative pressure increases within the fuel tank 8, a negative pressure valve, not shown, of the two-way valve 14 is opened to return part of the evaporative fuel stored in the canister 15 into the fuel tank 8. In the above described manner, the evaporative fuel generated within the fuel tank 8 is prevented from being emitted into the atmosphere.

Further, a mass flowmeter 20 is arranged across the purging passage 17 at a location between the canister 15 and the purge control valve 16, which detects the flow rate of a mixture of evaporative fuel and air flowing in the purging passage 17 and supplies a signal indicative of the detected flow rate to the ECU 5. The mass flowmeter 20 is a hot wire type which utilizes the nature of a platinum wire that when the platinum wire is heated by electric current applied thereto and at the same time exposed to a flow of gas, the platinum wire loses its heat to decrease in temperature so that its electric resistance decreases. Alternatively, it may be a thermo type comprising a thermistor of which the electric varies due to selfheating by electric current applied thereto or a change in the ambient temperature. Both the types of mass flowmeter detect variation in the concentration of evaporative fuel through variation in the electric resistance thereof.

The ECU 5 comprises an input circuit having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU") which executes a program for calculating a control parameter for controlling the opening of the purge control valve, etc., memory means storing programs executed by the CPU and for storing results of calculations therefrom, etc., and an output circuit which outputs driving signals to the fuel injection valves 6 and the purge control valve 16.

The ECU 5 controls the opening of the purge control valve 16 in such a manner that an output QH from the mass flowmeter 20 becomes equal to a desired value thereof. More specifically, the ECU 5 calculates a control parameter (hereinafter referred to as "the EPCV value") used in controlling the purge control valve 16 based on a corrected output value QH' of the output value QH of the flowmeter which is calculated by the following equation:

$$QH' = QH - QH0 \quad (1)$$

where the value QH0 is a zero point correction value used in correcting the zero point of the output value QH from the flowmeter, and manners of calculating the zero point correction value QH0 will be described below.

Figure 2:
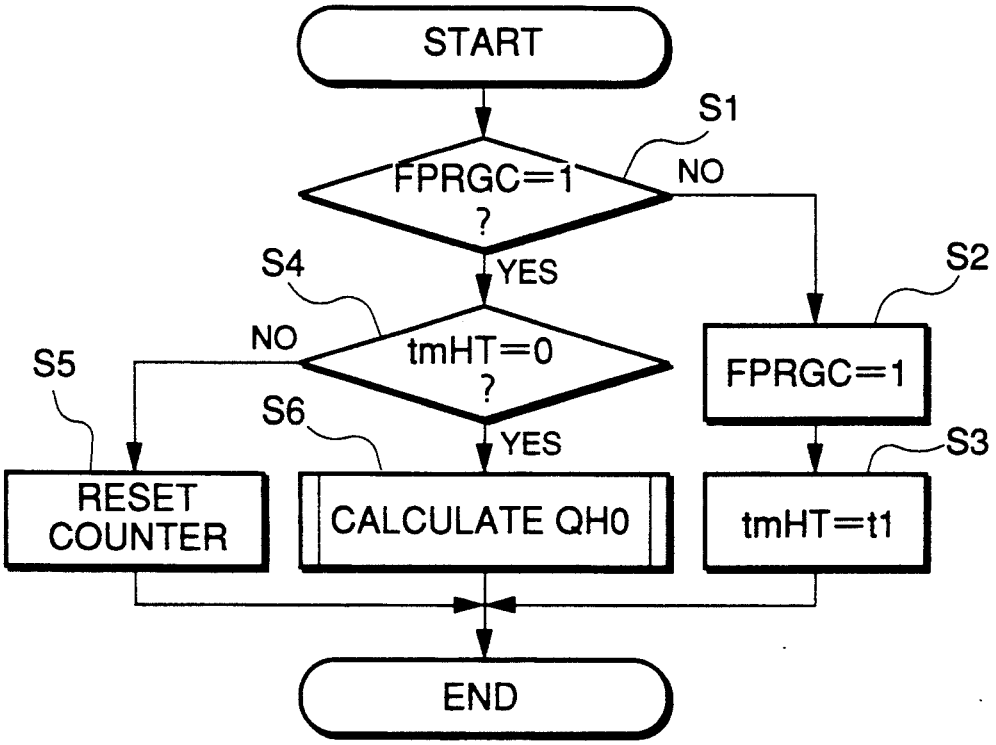
FIG. 2 is a flowcart of a routine for calculating a zero point correction value QH0.

FIG. 2 shows a program for calculating the zero point value QH0, which is carried out by the CPU within the ECU 5.

First, at a step S1, it is determined whether or not a flag FPRGC for zero point correction is equal to 1 to thereby determine whether the purge control valve 16 is fully closed for carrying out purge cut for calculating the zero point correction value. If the answer to this question is negative (No), the flag FPRGC is set to 1, thereafter carrying out purge cut for calculating the zero point correction value QH0 at a step S2, and then a timer tmHT is set to a predetermined time period t1 (which is required to elapse before the interior of the purging passage 17 has become stable) to start the timer tmHT at a step S3, followed by terminating the present program.

When the answer to the question of the step S1 becomes affirmative (Yes) in a subsequent loop, it is determined at a step S4 whether or not the value of the timer tmHT is equal to 0. If the answer to this question is negative (No), a counter for calculating the zero point correction value QH0 is reset to a predetermined time period T at a step S5, followed by terminating the present program, whereas, if the answer to the question of the step S4 is affirmative (Yes), the program proceeds to a step S6 to carry out calculation of the zero point correction value QH0, followed by terminating the present program.

Figure 3:
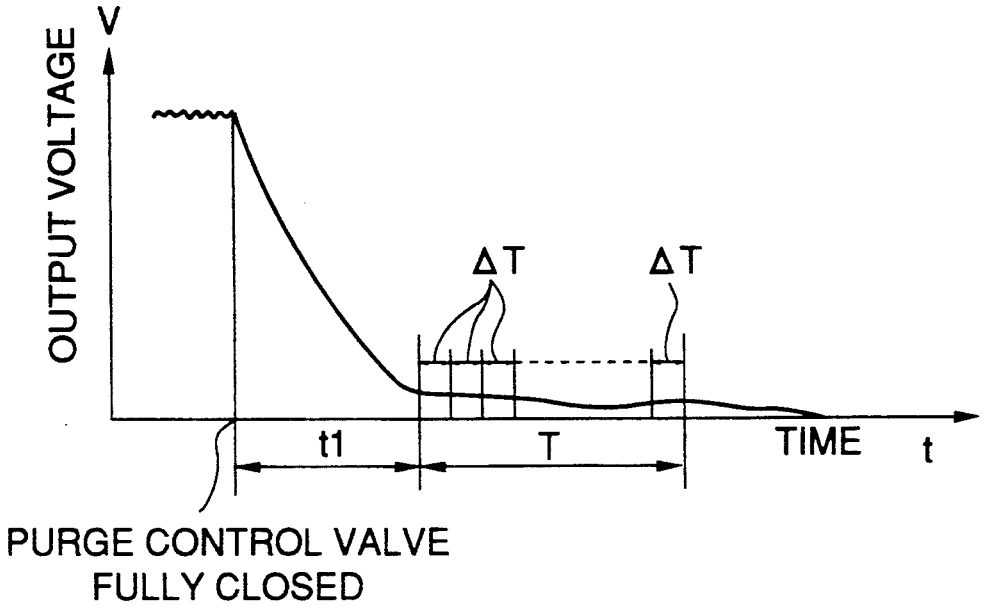
FIG. 3 is a graph showing output characteristics of a mass flowmeter, which is useful in explaining a manner of calculating the zero point correction value QH0.

More specifically, the calculation of the zero point correction value QH0 is carried out in the following manner: As shown in FIG. 3, when the predetermined time period t1 has elapsed after the purge control valve 16 was fully closed, the aforementioned counter is started, and the output voltage V from the mass flowmeter 20 is detected whenever a very short time period $\Delta T$ elapses, over the predetermined time period T. Then, an average value of the output voltage V over the time period T is calculated, and when the average value thus obtained is within a predetermined range, it is stored into the memory means, thereafter calculating the corrected output value QH' by the use of the aformentioned equation (1).

Thus, in the present embodiment, the output voltage V from the flowmeter 20 is read every very short time period $\Delta T$ over the predetermined time period T, and the average value thereof is used as the zero point correction value QH0. Therefore, the correction of the output value from the flowmeter 20 enables to accurately detect the purging flow rate irrespective of variations in the output characteristic between individual flowmeters used, temperature drift, and change in the output characteristic thereof with aging. Further, the zero point correction value can be accurately calculated within a short time period. As a result, the detecting accuracy of the flowmeter improves particularly when the purging flow rate is small, whereby it is possible to effect accurate air-fuel ratio control under a low load operating condition of the engine by the use of the purge control valve.

Figure 4:
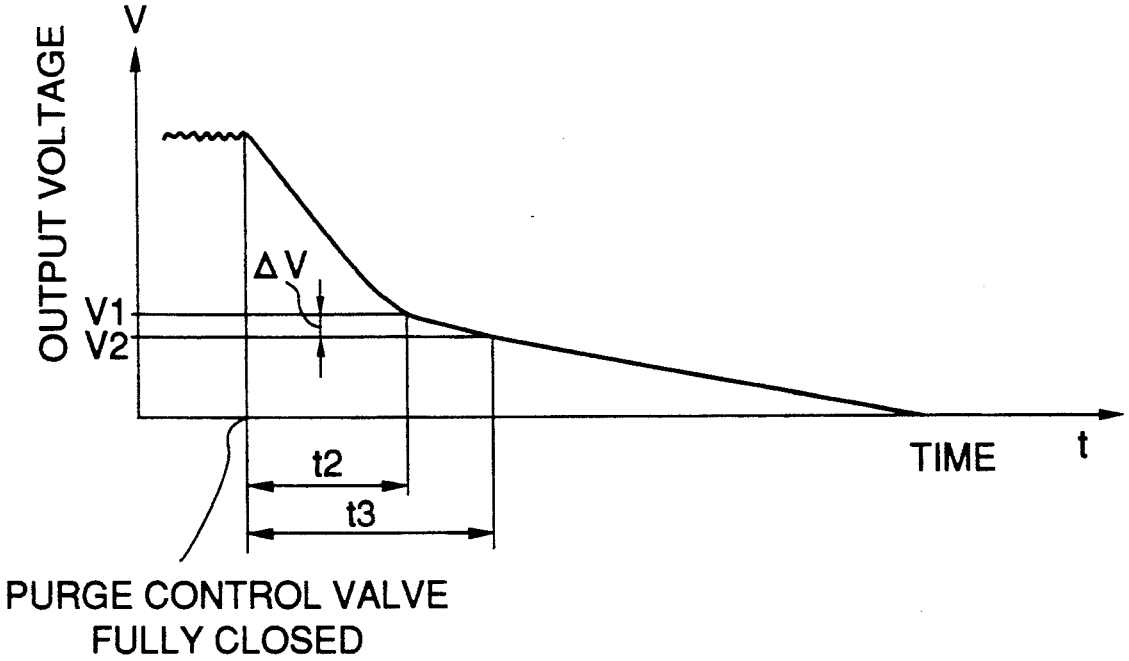
FIG. 4 is a graph showing output characteristics of a mass flowmeter, which is useful in explaining another manner of calculating the zero point correction value QH0.

FIG. 4 shows a variation of the manner of calculating the zero point correction value QH0, in which the output voltage from the mass flowmeter 20, which varies with the lapse of time after the purge control valve 16 was fully closed, is checked at two different time points, and the zero point correction value QH0 is calculated based on a change in the output voltage between the two time points.

More specifically, values V1 and V2 of the output voltage from the mass flowmeter 20 are detected, respectively, when predetermined time periods t2 and t3 have elapsed after the purge control valve 16 was fully closed, and the difference ΔV between the values V1 and V2 is calculated by the use of the following equation (2):

$$\Delta V = V1 - V2 \quad (2)$$

and then the zero point correction value QH0 is calculated by the use of the following equation (3):

$$QH0 = V1 - \Delta V \times \phi \quad (3)$$

where $\phi$ is a predetermined coefficient, which is set to a value depending on the output characteristic of the mass flowmeter 20.

According to this manner of calculating the zero point correction value QH0, effects similar to those mentioned above can be obtained. Particularly, although it normally takes 30 seconds before the output voltage from the mass flowmeter becomes equal to zero after the purge control valve 16 was fully closed, the zero point correction value QH0 is calculated, in the present embodiment, based on data obtained when or before the predetermined time period t3 has elapses, which enables to reduce time required for determining the zero point.

Figure 5:
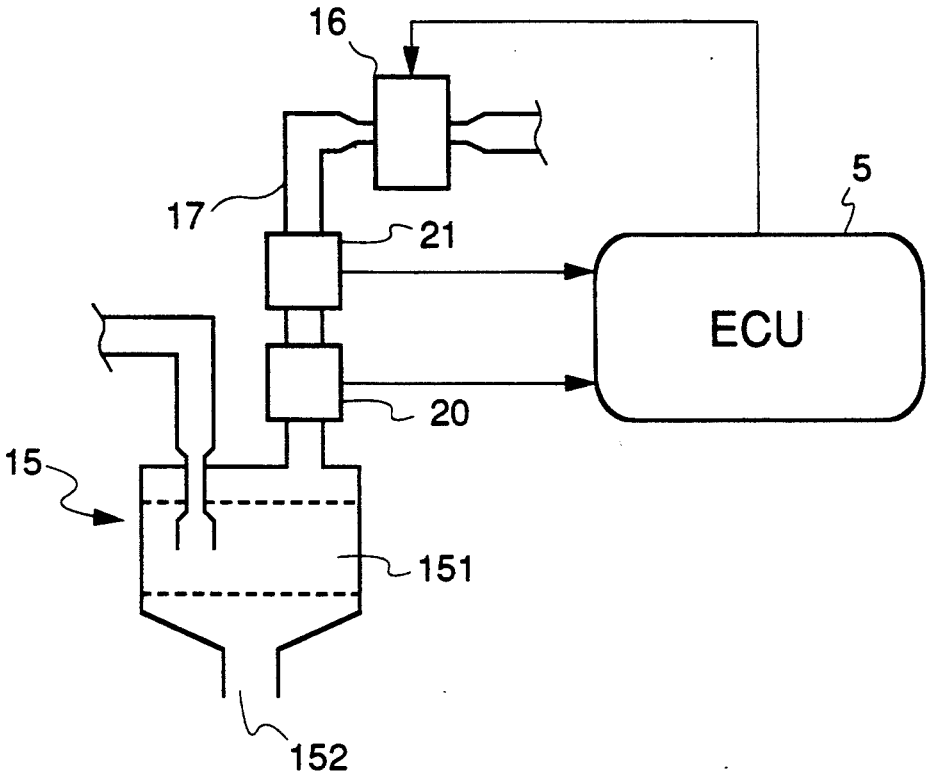
FIG. 5 is a block diagram showing essential parts of an evaporative fuel-purging control system according to a second embodiment of the invention.

FIG. 5 shows essential parts of an evaporative fuel-purging control system according to a second embodiment of the invention. This embodiment is distinguished from the first embodiment in that there is also provided a flowmeter 21 in the purging passage 17, which is a different type from the mass flowmeter 20 and accordingly has a different output characteristic from that of the mass flowmeter 20. The flowmeter 21 is also connected to the ECU 5 and supplies a signal indicative of the sensed flow rate to the ECU 5. The flowmeter 21 may be a volumetric flowmeter, for example. In the present embodiment, the two flowmeters are used to determine the concentration (vapor concentration) of evaporative fuel in the purging mixture and the purging flow rate by the use of different outputs from these flowmeters, by utilizing the fact that the outputs QH1 and QH2 from the flowmeters vary at respective different rates relative to the vapor concentration in the mixture flowing through the purging passage. More specifically, the flowmeters 20, 21 of different types both indicate output values which vary at respective different rates relative to the actual flow rate, as the density of an object gas (in the present case, a mixture of evaporative fuel and air) i.e. vapor concentration varies. For example, even if the actual volumetric flow rate is constant, they indicate different output values (indication amounts) between when the object gas is formed of 100% air (i.e. low density) and when the object gas is formed of 100% vapor (HC) (i.e. high density). When the gas is formed of 100% air, they output small values, whereas when the gas is formed of 100% vapor, they output large values. Further, the volumetric flowmeter 21 shows a different output characteristic curve relative to change in the density of the object gas, i.e. vapor concentration, from that of the mass flowmeter 20. For example, when the mixture is formed of 100% air, both the flowmeters indicate a value of 1.0, whereas when the mixture is formed of 100% vapor, the volumetric flowmeter 21 indicates a value smaller than a value indicated by the mass flowmeter 20. Details of the determination of the vapor concentration and the purging flow rate by the use of the different output characteristics of the two kinds of flowmeters are disclosed in U.S. Ser. No. 07/853,289 filed Mar. 18, 1992 and assigned to the same assignee of the present application.

In this embodiment, the ECU calculates, in the same manner as described above with reference to FIGS. 2 and 3, a zero point correction value QH10 for the flowmeter 20 and a zero point correction value QH20 for the flowmeter 21, when the aforementioned predetermined time t1 period has elapsed after the purge control valve 16 was fully closed, and stores the zero point correction values QH10 and QH20 into the memory means thereof when the values fall within respective predetermined ranges, i.e. respective predetermined medium value ranges and at the same time the absolute value of a difference DQH (=QH10−QH20) therebetween falls within a predetermined range. The latter condition is provided for avoiding determination of the zero point value in the event of a fault in one or both of the flowmeters, as well as avoiding determination of the zero point value based upon initial output values assumed by the flowmeters 20, 21 which are usually largely different from each other. Thereafter, the EPCV value is calculated based on a corrected output value QH1′ of the output QH1 from the mass flowmeter 20 and a corrected output value QH2′ of the output QH2 from the other flowmeter 21, the corrected values QH1′, QH2′ being calculated respectively, by the following equations:

$$QH1' = QH1 - QH10 \quad (4)$$

$$QH2' = QH2 - QH20 \quad (5)$$

In this embodiment as well, the values QH10, QH20 may be calculated in the other manner described with reference to FIG. 4.

Figure 6:
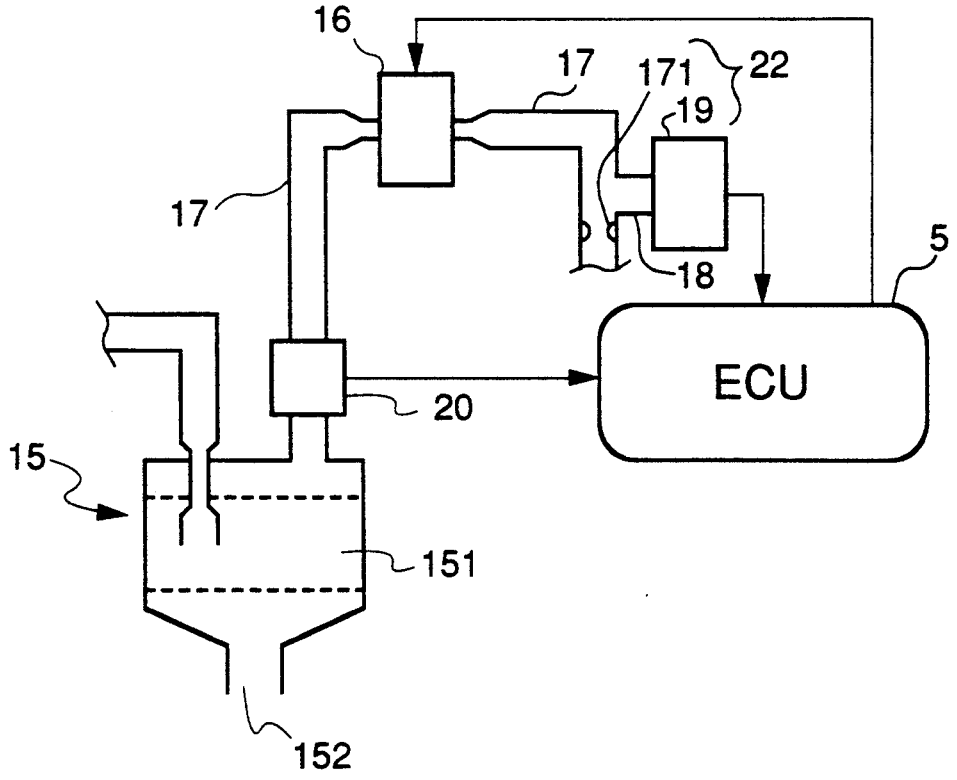
FIG. 6 is a block diagram showing essential parts of an evaporative fuel-purging control system according to a third embodiment of the invention.

FIG. 6 shows essential parts of an evaporative fuel-purging control system according to a third embodiment of the invention. According to this embodiment, a differential pressure type flowmeter 22 as a volumetric flowmeter is used in addition to the mass flowmeter 20. The differential pressure type flowmeter 22 is formed by a restriction 171 provided in an intermediate portion of the purging passage 17 downstream of the purge control valve 16, and a pressure gauge 19 is connected via a conduit 18 to the purging passage 17 at a location between the restriction 171 and the purge control valve 16. The pressure gauge 19 is formed by an atmospheric pressure-based differential pressure gauge which detects relative pressure PI within the purging passage 17 to atmospheric pressure and supplies a signal indicative of the sensed relative pressure PI to the ECU 5. The differential pressure type flowmeter is also formed by the ECU 5 such that the ECU 5 calculates the purging flow rate of the mixture passing through the restriction 171, based on the opening area of the restriction 171 and a value of the relative pressure PI detected by the pressure gauge 19. In addition, an evaporative fuel-purging control system of this type is disclosed in detail in the aforementioned U.S. Ser. No. 07/853,289.

The present embodiment also uses the two different types of flowmeters 20, 22 to determine the vapor concentration and the purging flow rate by the use of different outputs from these flowmeters, by utilizing the fact that outputs QH and QS from the flowmeters 20, 22 vary at respective different rates relative to the vapors concentration in the mixture flowing through the purging passage 17.

In this embodiment, the ECU calculates, in the same manner as described with reference to FIGS. 2 and 3, the zero point correction value QH0 for the flowmeter 20 and a zero point correction value QS0 for the flowmeter 22, when the predetermined time period has elapsed after the purge control valve 16 was fully closed, and stores the zero point correction values QH0 and QS0 into the memory means thereof when the output values fall within respective predetermined ranges, i.e. respective predetermined medium value ranges and at the same time the absolute value of a difference DQ (=QH0−QS0) therebetween falls within a predetermined range. Thereafter, the EPCV value is calculated based on a corrected output value QH' of the output QH from the mass flowmeter 20 and a corrected output value QS' of the output QS from the other flowmeter 22, calculated respectively, by the following equations:

$$QH' = QH - QH0 \quad (1)$$

$$QS' = QS - QS0 \quad (6)$$

The zero point correction values QH0, QS0 may be calculated in the other manner described with reference to FIG. 4.

Further, if a differential pressure gauge is used as the intake pipe pressure sensor 10, which detects differential pressure between atmospheric pressure and pressure within the intake pipe 2, theoretically the outputs from the intake pipe pressure sensor 10 and the differential pressure gauge 19 should be equal to each other when the purge control valve 16 is fully closed. Therefore, one of the outputs may be used for correcting the other.

Figure 7:
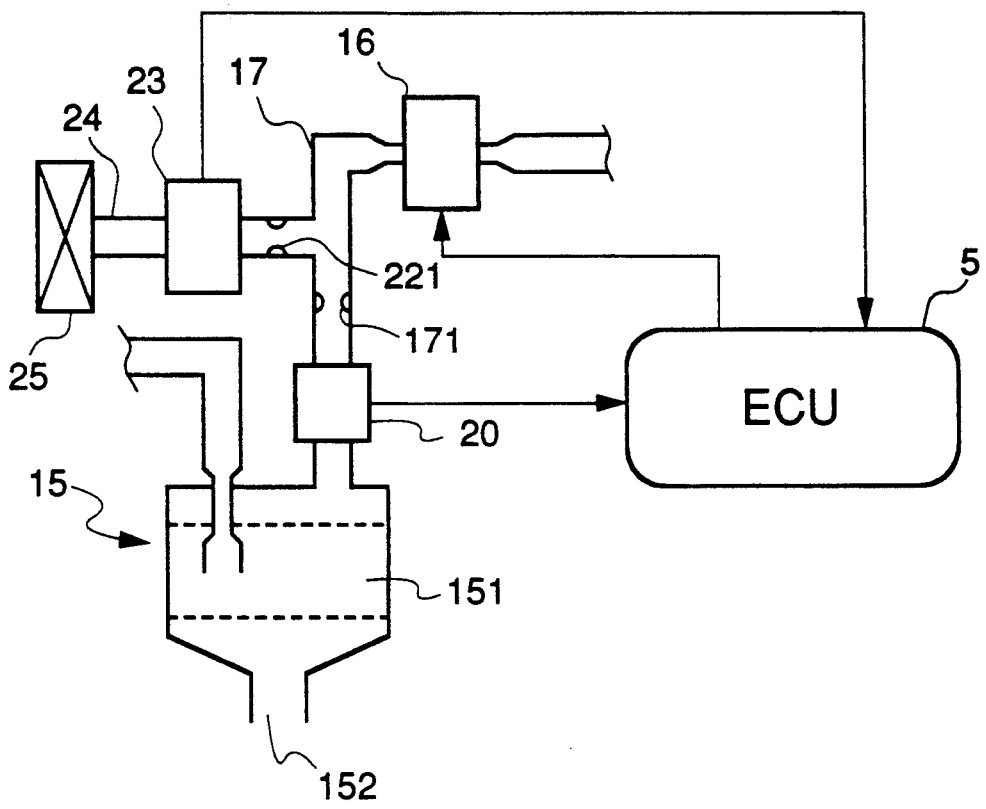
FIG. 7 is a block diagram showing essential parts of an evaporative fuel-purging control system according to a fourth embodiment of the invention.
Figure 8:
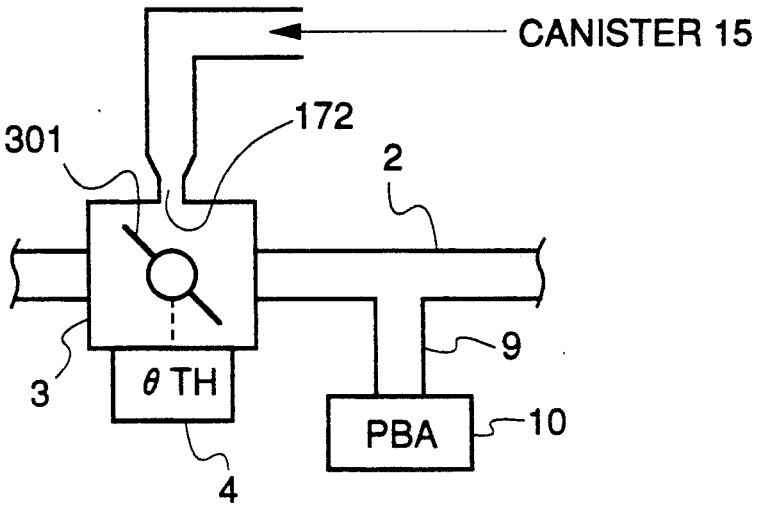
FIG. 8 is a schematic diagram showing a manner of connection between a purging passage and a throttle body.

FIG. 7 shows essential parts of an evaporative fuel-purging control system according to a fourth embodiment of the invention. This embodiment is distinguished from the above described embodiments in that a passage 24 connects an intermediate portion of the purging passage 17 with the atmosphere by way of an air cleaner 25, with a restriction 221 formed in an intermediate portion thereof, and a mass flowmeter 23 is mounted across the passage 24 at a location between the air cleaner 25 and the restriction 221. A restriction 171 is provided in the purging passage 17 at a location between its junction with the passage 24 and the flowmeter 20.

In the present embodiment, the ECU 5 calculates the zero point correction values QH10, QH20, and corrects outputs QH1 and QH2 from the respective two flowmeters 20 and 23 based on the zero point correction values QH10, QH20, and calculates the EPCV value by the use of the corrected output values QH1' and QH2'.

The second to fourth embodiments described above provide effects similar to those obtained by the first embodiment.

In the above embodiments, the zero point correction values (QH0, QH10, QH20, QS0) are renewed when the purge control valve 16 becomes fully closed. However, if the system is constructed e.g. as shown in FIG. 5 in which the purging passage 17 is connected via a port 172 at an end thereof to the interior of the throttle body 3 at such a location that the port 172 is positioned upstream of the throttle valve 301 when it is fully closed whereas it is positioned downstream of same when it is open, the renewal of the zero point correction values may be carried out when the throttle valve 301 is fully closed.

According to the first to fourth embodiments of the invention described above, the output(s) from the flowmeter(s) is (are) corrected by the use of a value (values) thereof assumed when the purge control valve is fully closed. Therefore, the purging flow rate can be detected accurately irrespective of variations in output characteristics between individual flowmeters used, temperature drift, and change in output characteristics thereof with aging. As a result, the detecting accuracy of the used flowmeter(s) is (are) improved particularly when the purging flow rate is small, which enables to carry out the air-fuel ratio control under low load operating conditions of the engine by the use of the purge control valve.

Next, there will be described a fifth embodiment of the invention. This embodiment is distinguished from the foregoing embodiments in that the purge control valve is formed by a duty controlled type 16', and except for this the construction and arrangement are identical with those of the first embodiment shown in FIG. 1. In this embodiment, the ECU calculates a desired value of the purging flow rate corresponding to an operating condition in which the engine is operating based on parameter signals indicative of the operating conditions, such as the engine rotational speed (NE), the intake pipe presure (PB), the air-fuel ratio, etc., and supplies a control signal having a duty ratio (ratio of energizing time of the purge control valve 16' per unit time) commensurate with the calculated desired value of the purging flow rate, to thereby drive the purge control valve 16' so as to control the purging flow rate.

Figure 9:
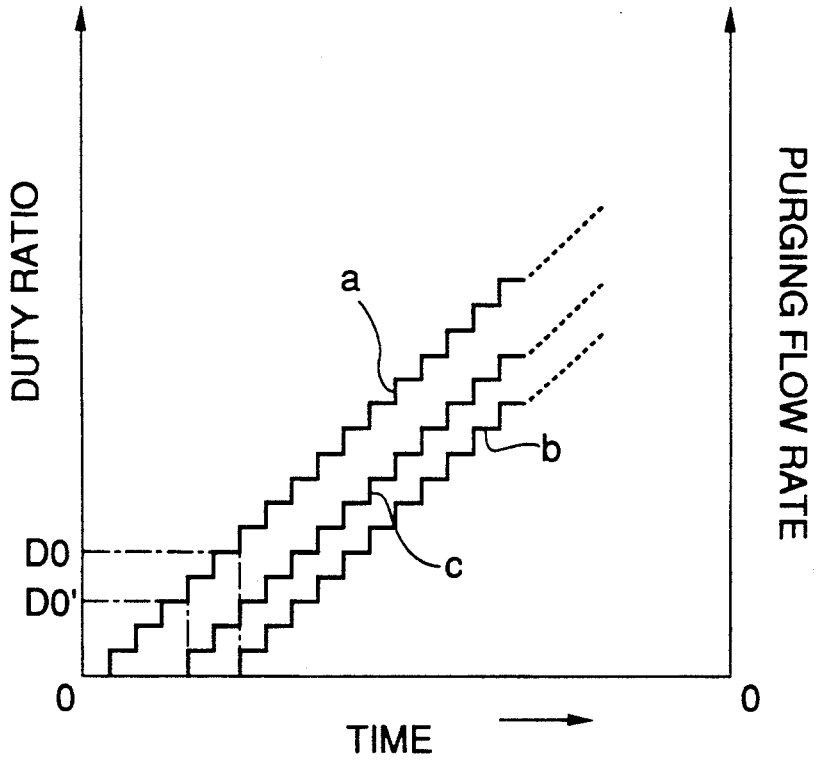
FIG. 9 is a graph showing change characteristics in the purging flow rate of an evaporative fuel-purging control system according to a fifth embodiment of the invention, employing a duty control type purge control valve.

If the duty ratio of the control signal is stepwise increased by a predetermined increment in a manner represented by a line a shown in FIG. 9, the purging flow rate rises from the minimum value when the duty ratio reaches a certain value and subsequently increases in proportion to the duty ratio in a manner represented by a line b shown in the figure. Therefore, the duty ratio corresponding to the desired purging flow rate is calculated by using a maximum value of the duty ratio at which the purging flow rate is maintained at the minimum value as a control zero point value D0. However, the control zero point value D0 changes with the lapse of time due to wear of moving parts of the purge control valve 16', settling of a valve spring thereof, etc. If the control zero point value D0 has changed to a value D0' as shown in the figure, the purging flow rate changes relative to the duty ratio of the control signal supplied to the purge control valve in such a shifted manner as represented by a line c shown in the figure. Therefore, if the duty ratio is calculated to the purging flow rate-changing characteristic indicated by the line b which is no longer actual, there necessarily arises an error in the resulting purging flow rate.

Figure 10:
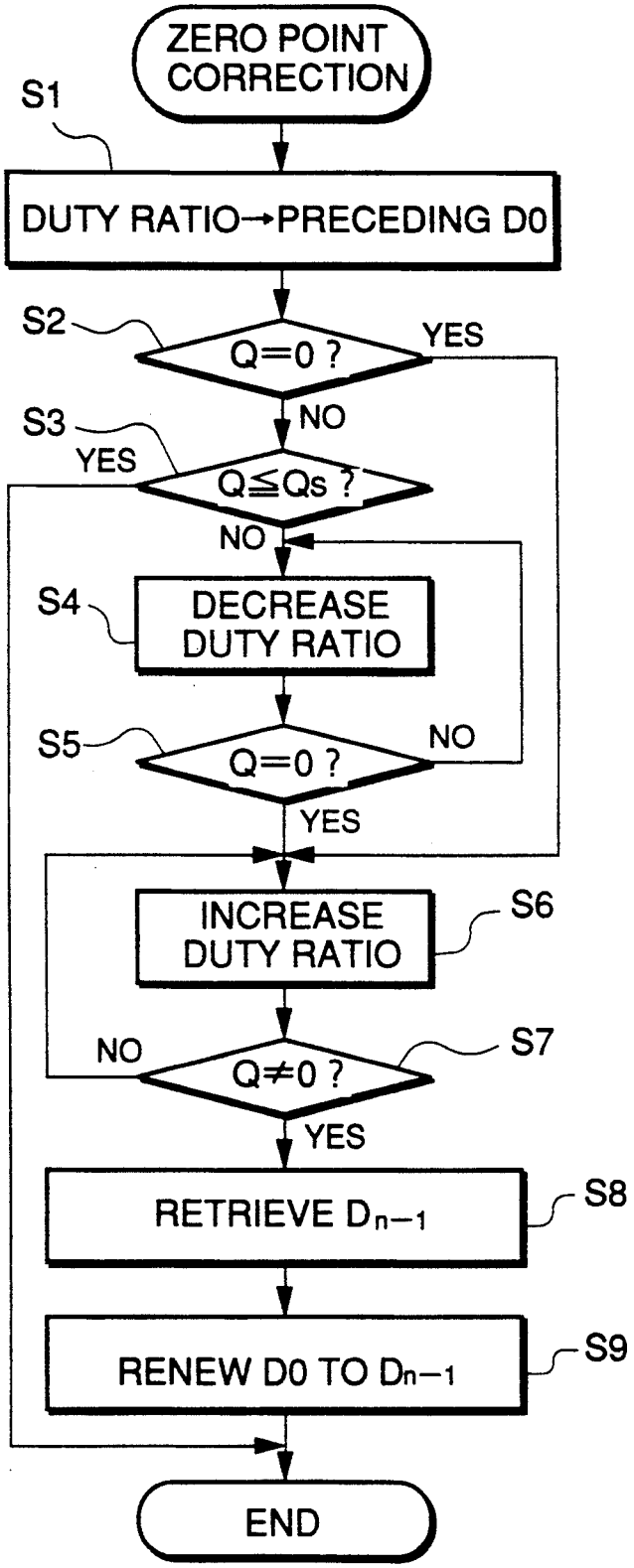
FIG. 10 is a flowchart showing a subroutine for correcting the control zero point of the duty ratio of the purge control valve according to the fifth embodiment.

In order to eliminate this inconvenience, according to this embodiment, the control zero point is corrected when the engine is in a predetermined operating condition, by a subroutine shown in FIG. 10.

First, the duty ratio of the control signal is decreased to the control zero point value DO which has been set on the immediately preceding occasion at a step S1, and then it is determined at a step S2 whether or not a value of the purging flow rate Q detected by the flowmeter 20 is equal to the minimum value. If the detected value of the purging flow rate Q is not equal to the minimum value, it is determined at a step S3 whether or not the detected value of the purging flow rate Q is within a predetermined tolerance range $Q_S$. If $Q \leqq Q_S$, the subroutine is immediately terminated without renewing the zero point value DO. If $Q > Q_S$, the duty ratio is stepwise decreased until the purging flow rate Q becomes equal to the minimum value (steps S4, S5). A decrement used in this duty ratio-reducing process is set to a relatively large value as shown in (a) of FIG. 11, to thereby promptly reduce the purging flow rate to the minimum value. In this connection, the decrement per se is decreased each time.

Figure 11:
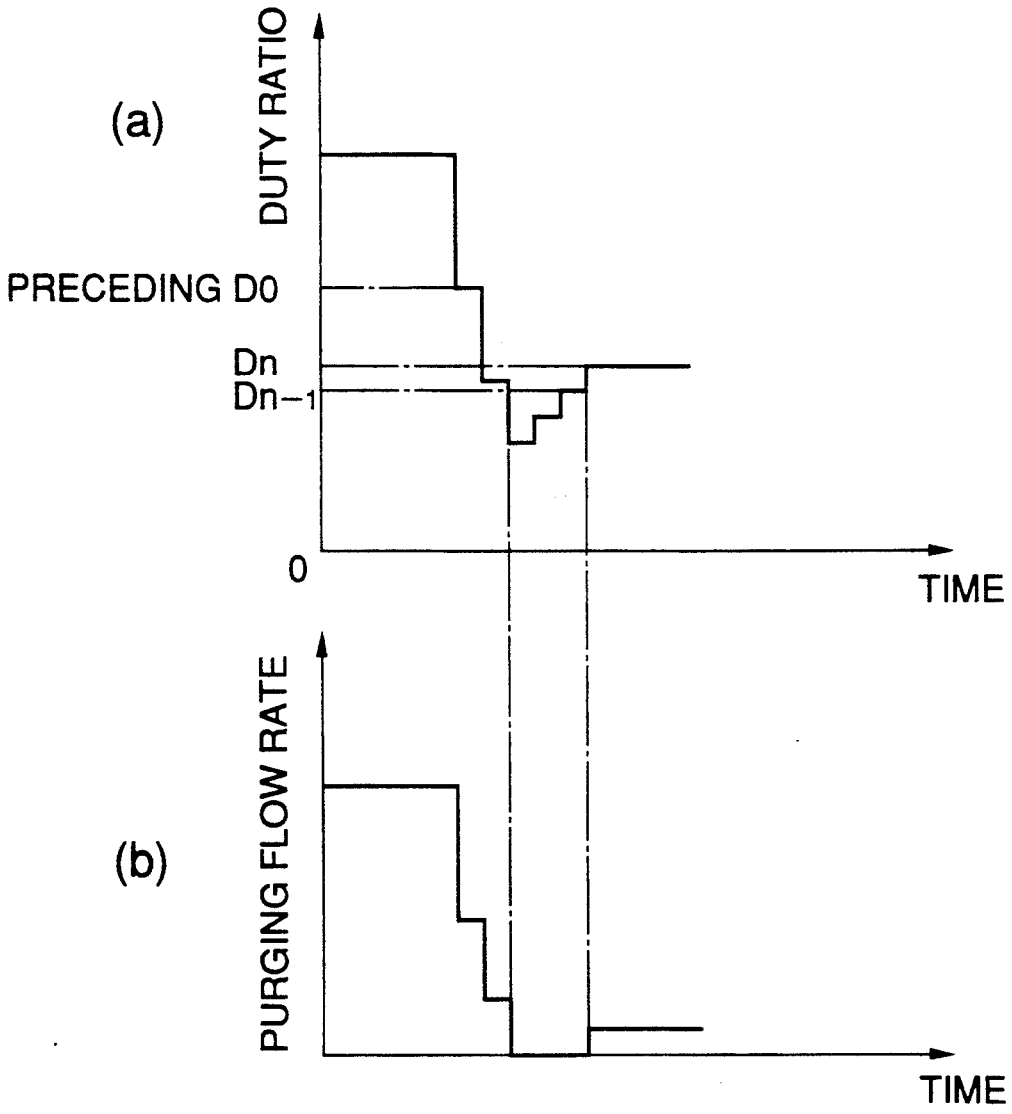
FIG. 11 is a graph showing changes (a) in the duty ratio taking place when the zero point correction is effected according to the fifth embodiment, and changes (b) in the purging flow rate resulting therefrom.

Once $Q=0$, then the duty ratio is increased in a stepwise manner as shown in (b) of FIG. 11 until the purging flow rate Q rises from the minimum value (steps S6, S7). An increment used in this duty-ratio increasing process is set to a predetermined value which is smaller than the value of the above-mentioned decrement. Then, a value $D_{n-1}$ of the duty ratio immediately preceding a value $D_n$ thereof at which the purging flow rate Q has ceased to be equal to the minimum value is memorized (step S8), and the control zero point D0 is renewed to the value $D_{n-1}$ at a step S9.

If the answer to the question of the step S2 is affirmative (Yes), i.e. if the purging flow rate Q detected by the flowmeter 20 when the duty ratio is decreased to the control zero point value DO is equal to the minimum value, the program jumps over to the step S6.

Although the above step S3 may be omitted, and the program may directly proceed from the step S2 to the step S4 whenever it is determined at the step S2 that the purging flow rate Q is not equal to the minimum value, the provision of the step S3 has an advantage of reducing time in correcting the control zero point value DO when the deviation from the zero point value DO is within the predetermined tolerance range QS.

In this manner, the purging flow rate can be accurately controlled to a desired value by correcting the control zero point value DO used in controlling the purge control valve. If the flowmeter 20 is formed by a hot-wire type mass flowmeter, the vapor concentration can also be detected from the ratio of a mass flow rate detected by the flowmeter 20 to a volumetric flow rate calculated as the desired purging flow rate.

As is clear from the above description, according to the present embodiment, even if the duty ratio of the control signal assumed immediately before a rise of the purging flow rate from the minimum value changes with aging, the control zero point is changed according to this change in the aforementioned maximum value of the duty ratio, which enables to accurately control the purging flow rate.

Figure 12:
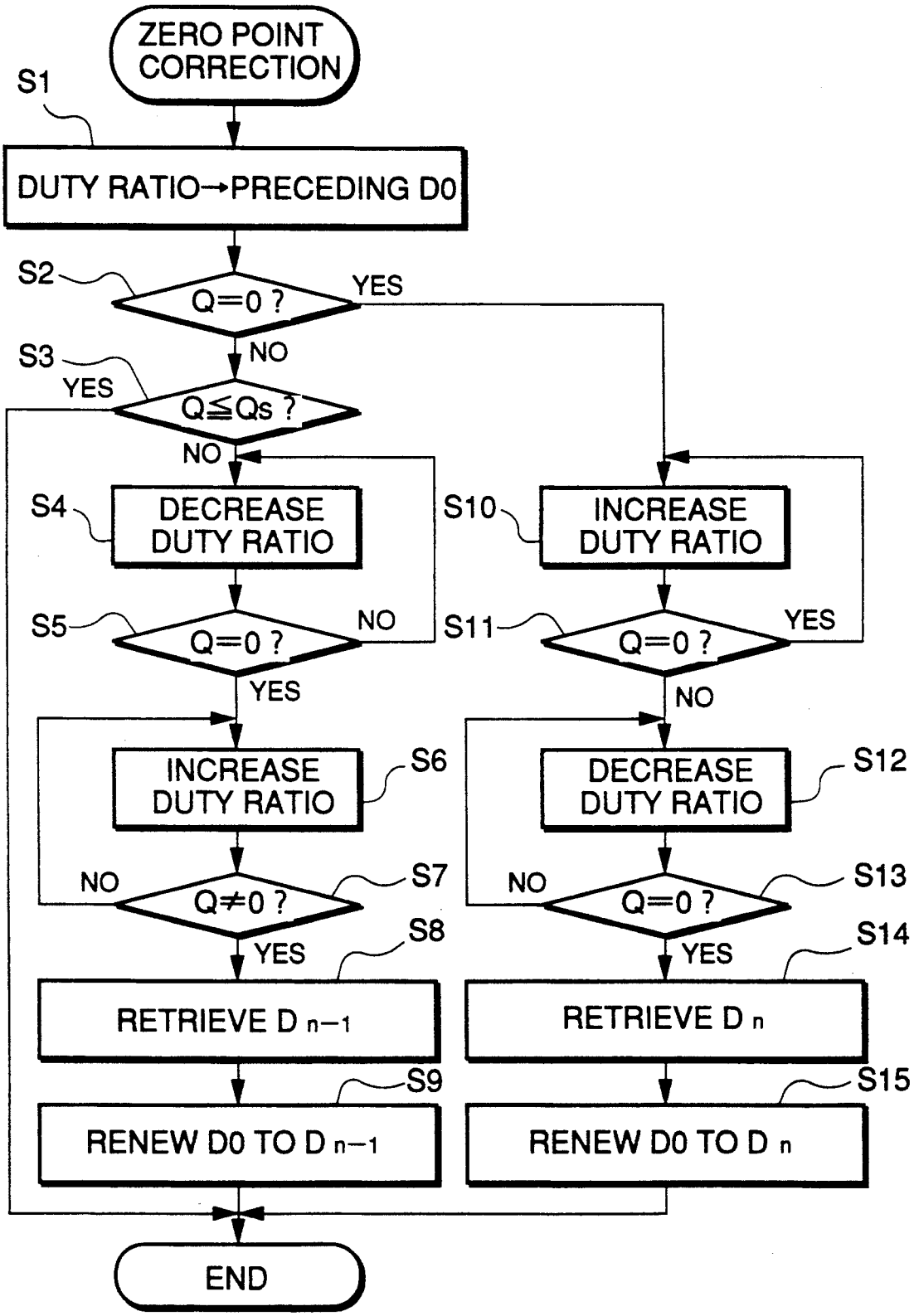
FIG. 12 is a flowchart showing a subroutine for correcting the control zero point of the duty ratio of the purge control valve according to a variation of the fifth embodiment.
Figure 13:
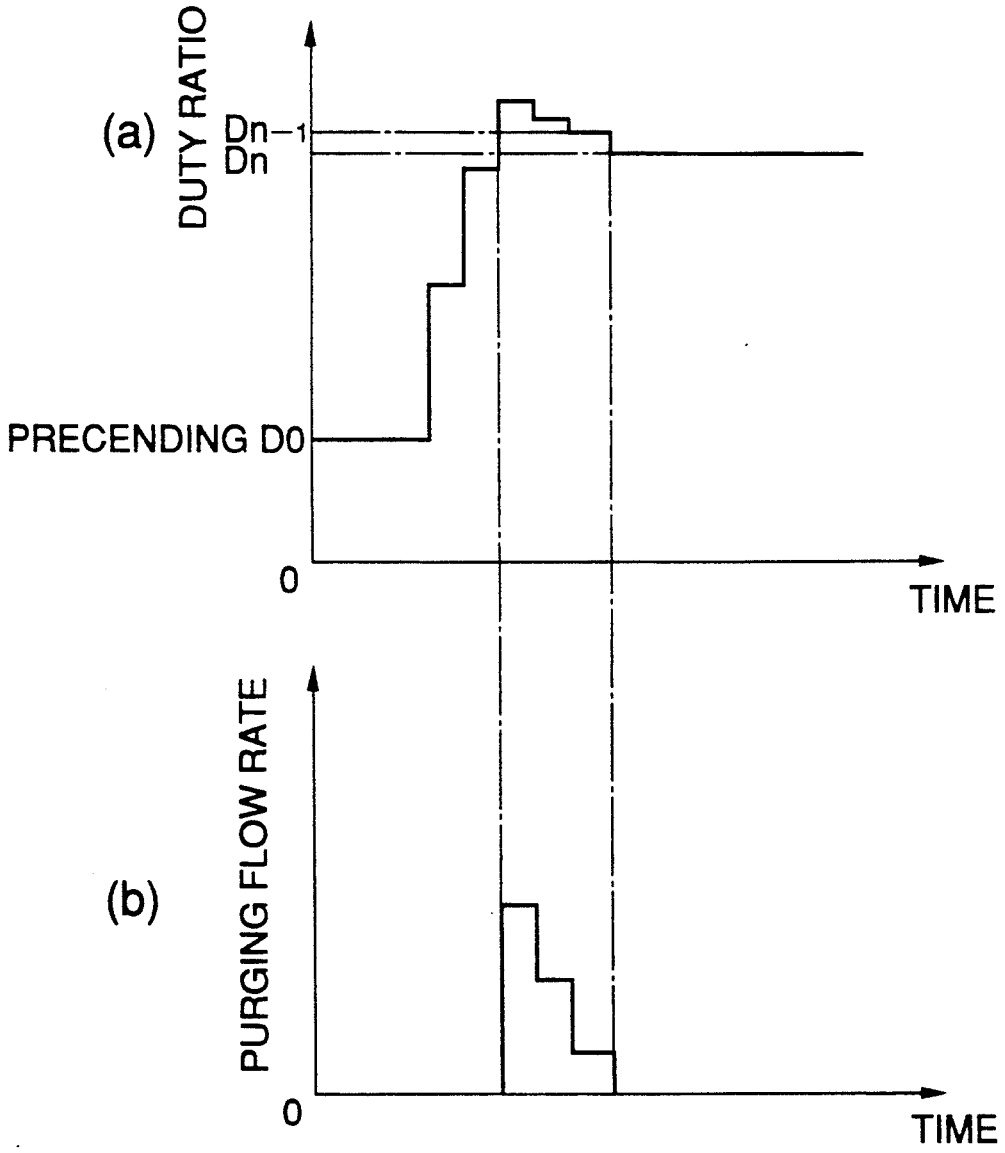
FIG. 13 is a graph showing changes (a) in the duty ratio taking place when the zero point correction is effected according to the variation of the fifth embodiment, and changes (b) in the purging flow rate resulting therefrom.

FIGS. 12 and 13 show a variation of the fifth embodiment. This variation is distinguished from the fifth embodiment in that the flowchart of FIG. 12, which shows a subroutine for renewing the control zero point, includes additional steps of S10 to S15. These additional steps form an improvement made on the control zero point-renewing subroutine of FIG. 10 in respect of the manner of renewing the control zero point value D0 in the case where the purging flow rate Q detected by the flowmeter is equal to the minimum value when the duty ratio is decreased to the control zero point value currently in use. More specifically, according to the subroutine of the fifth embodiment, in which the increment used in the duty ratio-increasing process carried out at the steps S6 and S7 is set to a relatively small value as described above for the purpose of accurately detecting the aforementioned maximum value of the duty ratio, if the control zero point value D0 currently in use is far smaller than the aforementioned maximum value, it takes much time before the duty ratio is increased to a point where the purging flow rate Q rises from the minimum value. The present variation eliminates this incovenience. The description of the steps of FIG. 12 corresponding to those of FIG. 10 of the fifth embodiment is omitted.

If the answer to the question of the step S2 is affirmative (Yes), i.e. if the purging flow rate Q detected by the flowmeter 20 when the duty ratio is reduced to the preceding control zero point value D0 is equal to the minimum value, the program proceeds to steps S10, S11, where the duty ratio is stepwise increased until the purging flow rate Q ceases to be equal to the minimum value. An increment used in this duty ratio-increasing process is set to a relatively large value as shown in (a) of FIG. 13, to thereby promptly increase the purging flow rate to a point where the purging flow rate rises from the minimum value. In this connection, the increment per se may be decreased each time.

Once the purging flow rate Q is not equal to the minimum value, then the duty ratio is decreased in a stepwise manner as shown in (b) of FIG. 13 until the purging flow rate Q becomes equal to the minimum value (steps S12, S13). A decrement used in this duty-ratio reducing process is set to a predetermined value which is smaller than the value of the above-mentioned increment. Then, a value $D_n$ of the duty ratio at which the purging flow rate Q has become equal to the minimum value is stored (step S14), and the control zero point value D0 is renewed to the value $D_n$ at a step S15.

According to this variation, when the control zero point value D0 of the duty ratio is far smaller than a maximum value thereof at which the purging flow rate Q remains equal to the minimum value, it is possible to reduce time required for renewing the control zero point value D0.

In addition, the aspect of the invention embodied in the first to fourth embodiments, in which the zero point correction is effected on detected value(s) of the purging flow rate (i.e. output(s) from the flowmeter(s)), and the other aspect thereof embodied in the fifth embodiment, in which the zero point correction is effected on the control amount for the purging flow rate (i.e. the duty ratio of the control signal supplied to the purge control valve), can be put into practice in a combined manner.

Specifically, first, the duty ratio of the control signal is reduced to a value which ensures that the purging flow rate is equal to the minimum value (i.e. the duty controlled purge control valve is fully closed), and thereafter the zero point correction value(s) mentioned in the first to fourth embodiments are calculated and stored. Then, the zero point correction value(s) thus obtained is/are used as the minimum value of the purging flow rate referred to in the fifth embodiment, whereby the control zero point value D0 used in the fifth embodiment is renewed and stored.

What is claimed is:

1. In an evaporative fuel-purging control system for an internal combustion engine having a fuel tank, and an intake passage, said evaporative fuel-purging control system including a canister for adsorbing evaporative fuel generated from said fuel tank, a purging passage connecting between said canister and said intake passage for purging a gaseous mixture containing said evaporative fuel therethrough into said intake passage, at least one flowmeter arranged across said purging passage for outputting a detection parameter indicative of a flow rate of said gaseous mixture being purged through said purging passage, and a purge control valve arranged across said purging passage for controlling said flow rate of said gaseous mixture supplied to said intake passage, based on a control parameter indicative of a control amount for said purge control valve, the improvement comprising correcting means for correcting one of said detection parameter and said control parameter, based on a value of said one of said detection parameter and said control parameter assumed and stored when the other of said detection parameter and said control parameter assumes a value corresponding to a state in which said flow rate of said gaseous mixture is equal to the minimum value.

2. In an evaporative fuel-purging control system for an internal combustion engine having a fuel tank, and an intake passage, said evaporative fuel-purging control system including a canister for adsorbing evaporative fuel generated from said fuel tank, a purging passage connecting between said canister and said intake passage for purging a gaseous mixture containing said evaporative fuel therethrough into said intake passage, at least one flowmeter arranged across said purging passage for outputting an output value indicative of a flow rate of said gaseous mixture being purged through said purging passage, and a purge control valve arranged across said purging passage for controlling said flow rate of said gaseous mixture supplied to said intake passage, the improvement comprising output correcting means for determining at least one zero point correction value, based on said output value outputted from said at least one flowmeter when said purge control valve is fully closed, and correcting said output value outputted from said at least one flowmeter based on said at least one zero point correction value determined, when said gaseous mixture is purged.

3. An evaporative fuel-purging control system according to claim 2, wherein said output correcting means determines and stores said at least one zero point correction value based on said output value from said at least one flowmeter outputted after a predetermined time period has elapsed after said purge control value was fully closed, and corrects an output value subsequently outputted from said at least one flowmeter based on said at least one zero point correction value stored.

4. An evaporative fuel-purging control system according to claim 3, wherein said output correcting means calculates an average value of said output value from said at least one flowmeter outputted over a second predetermined time period after said first-mentioned predetermined time period elapsed after said purge control valve was fully closed, and stores said average value calculated, as said at least one zero point correction value.

5. An evaporative fuel-purging control system according to claim 4, wherein said average value is an average value of values outputted from said at least one flowmeter whenever a very short time period elapses, over said second predetermined time period.

6. An evaporative fuel-purging control system according to claim 3, wherein said output correcting means calculates a difference between output values outputted from said at least one flowmeter when third and fourth predetermined time periods have passed after said purge control valve was fully closed, and calculates and stores said at least one zero point correction value based on said difference calculated.

7. An evaporative fuel-purging control system according to claim 6, wherein said at least one zero point correction value is calculated by subtracting a product of said difference multiplied by a predetermined coefficient, from an output value outputted from said at least one flowmeter when said third predetermined time period has elapsed.

8. An evaporative fuel-purging control system according to claim 3, wherein when said at least one zero point correction value falls within a predetermined range, said output correcting means stores and thereby renews said at least one zero point correction value.

9. An evaporative fuel-purging control system according to any of claims 2 to 8, wherein said at least one flowmeter comprises a mass flowmeter.

10. An evaporative fuel-purging control system according to claim 9, wherein said mass flowmeter is a hot wire type.

11. An evaporative fuel-purging control system according to any of claims 2 to 8, wherein said at least one flowmeter comprises a mass flowmeter and a second flowmeter of another type having a different output characteristic from that of said mass flowmeter.

12. An evaporative fuel-purging control system according to claim 11, wherein when said zero point correction values for said mass flowmeter and said second flowmeter fall within respective predetermined ranges, and at the same time an absolute value of a difference between said zero point correction values for said mass flowmeter and said second flowmeter falls within a predetermined range, said output correcting means stores and thereby renews said zero point correction values for said mass flowmeter and said second flowmeter.

13. An evaporative fuel-purging control system according to claim 11, wherein said second flowmeter is a volumetric flowmeter.

14. An evaporative fuel-purging control system according to claim 12, wherein said second flowmeter is a volumetric flowmeter.

15. An evaporative fuel-purging control system according to claim 13, wherein said volumetric flowmeter is a differential pressure type flowmeter.

16. An evaporative fuel-purging control system according to claim 14, wherein said volumetric flowmeter is a differential pressure type flowmeter.

17. An evaporative fuel-purging control system according to any of claims 2 to 8, wherein said at least one flowmeter comprises first and second mass flowmeters, said purging passage comprising a main passage extending from said canister, said main passage having said first mass flowmeter and said purge control valve arranged therein, and a branch passage branching off said main passage at an intermediate location between said first mass flowmeter and said purge control valve and communicating with the atmosphere, said branch passage having said second mass flowmeter arranged therein.

18. An evaporative fuel-purging control system according to claim 17, wherein when said zero point correction values for said first mass flowmeter and said second mass flowmeter fall within respective predetermined ranges, and at the same time an absolute value of a difference between said zero point correction values for said first mass flowmeter and said second mass flowmeter falls within a predetermined range, said output correcting means stores and thereby renews said zero point correction values for said first mass flowmeter and said second mass flowmeter.

19. In an evaporative fuel-purging control system for an internal combustion engine having a fuel tank, and an intake passage, said evaporative fuel-purging control system including a canister for adsorbing evaporative fuel generated from said fuel tank, a purging passage connecting between said canister and said intake passage for purging a gaseous mixture containing said evaporative fuel therethrough into said intake passage, at least one flowmeter arranged across said purging passage for outputting an output value indicative of a flow rate of said gaseous mixture being purged through said purging passage, and a duty controlled type purge control valve arranged across said purging passage and supplied with a control signal for controlling said flow rate of said gaseous mixture supplied to said intake passage, the improvement comprising zero point correcting means for detecting a maximum value of a duty ratio of said control signal supplied to said purge control valve at which said flow rate of said gaseous mixture detected by said at least one flowmeter is maintained at the minimum value, and renewing a control zero point value of said duty ratio of said control signal to the detected maximum value of the duty ratio of said control signal, a value of said duty ratio corresponding to a desired value of said flow rate of said gaseous mixture being determined with reference to said control zero point.

20. An evaporative fuel-purging control system according to claim 19, wherein said zero point correcting means progressively decreases said duty ratio until said flow rate of said gaseous mixture becomes equal to the minimum value, and then progressively increases said duty ratio until said flow rate of said gaseous mixture is no longer equal to the minimum value.

21. An evaporative fuel-purging control system according to claim 20, wherein said progressive decrease of said duty ratio is effected by the use of a decrement which is larger than an increment used in said progressive increase of said duty ratio.

22. An evaporative fuel-purging control system according to claim 21, wherein said decrement is progressively decreased.

23. An evaporative fuel-purging control system according to any of claims 19 to 21, wherein when said flow rate of said gaseous mixture detected by said flowmeter is within a predetermined tolerance range when the duty ratio of the control signal is reduced to a value of the control zero point value currently in use, said renewal of said control zero point value is omitted.

24. An evaporative fuel-purging control system according to claim 19, wherein said zero point correcting means progressively increases said duty ratio until said flow rate of said gaseous mixture rises from the minimum value, and then progressively decreases said duty ratio until said flow rate of said gaseous mixture becomes equal to the minimum value.

25. An evaporative fuel-purging control system according to claim 24, wherein said progressive increase of said duty ratio is effected by the use of an increment which is larger than a decrement used in said progressive decrease of said duty ratio.

26. An evaporative fuel-purging control system according to claim 25, wherein said increment is progressively decreased.

* * * * *